US011348433B2

(12) United States Patent
Grammer

(10) Patent No.: US 11,348,433 B2
(45) **Date of Patent: *May 31, 2022**

(54) WEARABLE DEVICE ADAPTED FOR FALL DETECTION AND TRANSMISSION OF AUTOMATED NOTIFICATIONS FOR EMERGENCY ASSISTANCE

(71) Applicant: Jeff Daniel Grammer, Louisville, KY (US)

(72) Inventor: Jeff Daniel Grammer, Louisville, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/948,692

(22) Filed: Sep. 29, 2020

(65) Prior Publication Data

US 2021/0192921 A1 Jun. 24, 2021

Related U.S. Application Data

(63) Continuation of application No. 15/929,313, filed on Apr. 24, 2020, now Pat. No. 10,916,115.

(60) Provisional application No. 62/950,731, filed on Dec. 19, 2019.

(51) Int. Cl.
*G08B 21/04* (2006.01)

(52) U.S. Cl.
CPC ..... *G08B 21/0446* (2013.01); *G08B 21/043* (2013.01)

(58) Field of Classification Search
CPC combination set(s) only.
See application file for complete search history.

(56) References Cited

U.S. PATENT DOCUMENTS

2007/0162156 A1* 7/2007 Chu ..... A61F 13/42 700/13
2012/0146797 A1* 6/2012 Oskin ..... A61B 5/6804 340/573.1
2015/0123785 A1* 5/2015 Haflinger ..... A61B 5/6822 340/539.11
2016/0034731 A1* 2/2016 Lin ..... A61B 5/0026 340/10.1

* cited by examiner

*Primary Examiner* — Nabil H Syed
*Assistant Examiner* — Cal J Eustaquio
(74) *Attorney, Agent, or Firm* — Dunlap Bennett & Ludwig, PLLC

(57) ABSTRACT

A wearable safety device is provided. The wearable safety device is adapted to detect wearer fall events and shock events and transmit automated notifications if such events have been detected. The wearable safety device utilizes an accelerometer or equivalent components to determine a rate of fall associated with a fall event and determine a magnitude of shock associated with a shock event. The accelerometer, transmission component and a microprocessor coupled to both is dimensioned and adapted to be woven between two layers of fabric by conductive thread, thereby enabling an ever present, wearable device to detect when the wearer has dangerously fallen and proactively request assistance.

4 Claims, 2 Drawing Sheets

WEARABLE DEVICE ADAPTED FOR FALL DETECTION AND TRANSMISSION OF AUTOMATED NOTIFICATIONS FOR EMERGENCY ASSISTANCE

CROSS-REFERENCE TO RELATED APPLICATION

This application claims the benefit of priority of U.S. non-provisional application Ser. No. 15/929,313, filed 24 Apr. 2020, as a continuation thereof, the contents of which are herein incorporated by reference.

BACKGROUND OF THE INVENTION

The present invention relates to emergency assistance devices and, more particularly, a wearable IoT device adapted for fall detection and an associated transmission of automated notifications for emergency assistance.

All current medical alert systems require the user to actively push a button or interact with it prior to a call for help to go out. People who fall, such as the elderly, however, may be unconscious, confused, scared and/or panicked and so unable, or unable to remember, to press a panic button or otherwise sufficiently interact with their medical alert system. As a result, emergency assistance is not so notified. Furthermore, current medical alert systems are passive, 'dumb' devices which do not register a fall, and as a result, they do not know when a possible life-threatening event occurs absent input from the fallen, possibly seriously or unconscious injured individual.

As can be seen, there is a need for a wearable Internet of Things (IoT) device adapted for fall detection and transmission of automated notifications for emergency medical personnel to respond.

The present invention is embodied in a wearable IoT device that can be either sewn into fabric or worn as a lightweight "brooch" or other accessory. The present invention is "proactive" as it detects falls of wearers and sends the automated notification, instead of waiting for the fallen individual to manage to push a button to activate the alert.

The present invention uses wearable technology that is so tiny it can be sewn into fabric of an article of clothing or accessory. Moreover, the wearable device is adapted to measure the rate of fall, and when a fallen condition has been identified, uses other embedded wireless technology to automatically send an alert to notify medical personnel to respond, without requiring the fallen, possibly immobile, individual to actively seek help.

SUMMARY OF THE INVENTION

In one aspect of the present invention, a wearable fall detection device includes the following: an accelerometer; a control circuitry; a wireless communicator; and a plurality of conductive threading electrically connecting the accelerometer, the control circuitry, and the wireless communicator in such a way that the wearable fall detection device is interwoven between two abutting pieces of material.

In another aspect of the present invention, the wearable fall detection device further includes the following: a power source electrically connected to the control circuitry, wherein the plurality of conductive threading comprises stainless steel thread; the control circuitry configured to determine a fall event of a wearer of the two abutting pieces of material; the control circuitry adapted to: determine its location along an X-axis, a Y-axis, and a Z-axis at a predetermined time period in such a way as to determine a rate of fall along the Z-axis for a wearer of the two abutting pieces of material; compare the rate of fall to a gravity fall rate; and define a fall event when the rate of fall equals to or is greater than the gravity rate of fall, wherein the predetermined time period is more than zero seconds and less than 10 seconds, wherein the control circuitry is configured to enable the wireless communicator to notify one or more first responders, wherein the wireless communicator enables bi-directional communications with said first responders, wherein the wireless communicator enables bi-directional communications with said first responders.

In yet another aspect of the present invention, a method of enabling a medical alert system which does not require a user to actively engage or interact with the medical alert system prior to a notification to one or more first responders being sent, including the following: providing the above-mentioned wearable fall detection device, wherein the two abutting pieces of material are a portion of an article of clothing; and wearing the article of clothing.

These and other features, aspects and advantages of the present invention will become better understood with reference to the following drawings, description and claims.

DETAILED DESCRIPTION OF THE INVENTION

Figure 1:
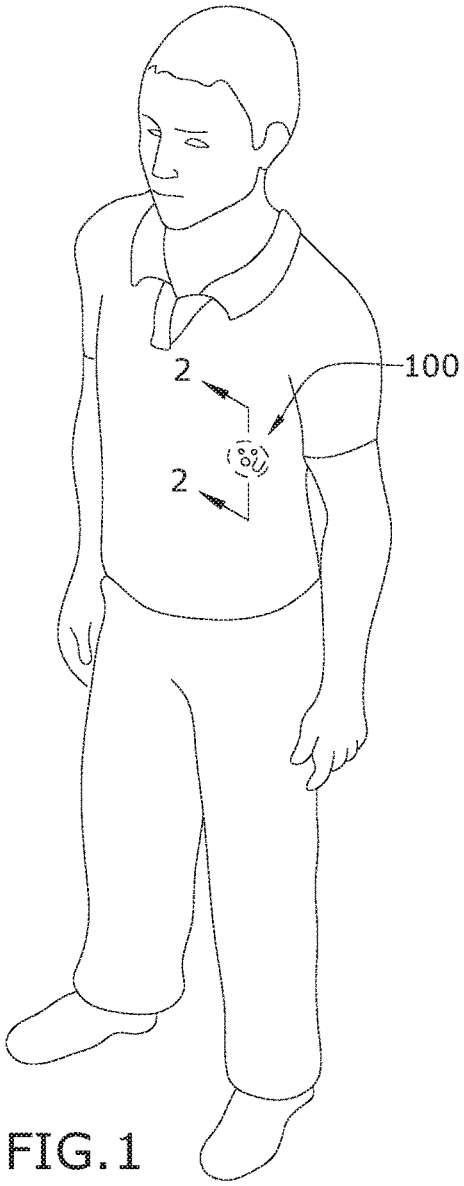
FIG. 1 is a schematic view of an exemplary embodiment of the present invention, shown in use in an upright, non-fallen position.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a wearable safety device adapted to detect wearer fall events and shock events and transmit automated notifications if such events have been detected. The wearable safety device utilizes an accelerometer or equivalent components to determine a rate of fall associated with a fall event and determine a magnitude of shock associated with a shock event. The accelerometer, transmission component and a microprocessor coupled to both is dimensioned and adapted to be woven between two layers of fabric by conductive thread, thereby enabling an ever present, wearable device to detect when the wearer has dangerously fallen and proactively request assistance.

Referring to FIGS. 1 through 4, the present invention may include at least one computer with a user interface. The computer may include at least one processing unit coupled to a form of memory. The computer may include, but not limited to, a microprocessor, a server, a desktop, laptop, and smart device, such as, a tablet and smart phone. The computer includes a program product including a machinereadable program code for causing, when executed, the computer to perform steps. The program product may include software which may either be loaded onto the computer or accessed by the computer. The loaded software may include an application on a smart device. The software may be accessed by the computer using a web browser. The computer may access the software via the web browser using the internet, extranet, intranet, host server, internet cloud and the like.

The computer can be a wearable processor 10, such as a CPU module or control circuitry, electrically coupled to a wearable accelerometer module 20, a wearable communications module 30, and a power source 40, such as a dual coin watch-battery or the like. The communication module 30 may be a wireless communicator such as Bluetooth™ technology or other wireless communication capabilities. The wearable processor 10, accelerometer module 20, communications module 30, and power source 40 may be embodied in the safety device 100.

The wearable processor 10 is where the software operates for providing the decision-making, sensor-monitoring, calculations and communication functionality disclosed herein. The wearable processor 10 monitors the accelerometer module 20 for fall events. If the CPU module 10 detects a fall event it sends an alert out through the communications module 40.

The software on the wearable processor 10 monitors the accelerometer module 20 so as determined when a wearer of the device moves from an unfallen position to a fallen position. Such movement is determined through the software calculating the position of the wearing by way of determining the X, Y, Z axis every predetermined time segment, such as every ten milliseconds (ms). A fall event is recorded by the software by wearable processor 10 accepting input from the accelerometer module 20 and calculating that input to determine if the calculation moves to near zero. The wearable processor 10 and software monitors the accelerometer module 20 to further determine if the free-fall, (near zero calculation event), is immediately followed by a shock-event, on the accelerometer. If the shock-event registers less than, say, five m/s on X, Y, axis of the accelerometer and 9.8 m/s on the Z axis (gravity fall rate) for long than five seconds, the wearable processor 10 sends out an alert through the communications module 40 to an application running on any monitoring computing device, such as a smartphone, laptop, nursing station computer, or any device capable of running the application and triggering an alarm.

Figure 2:
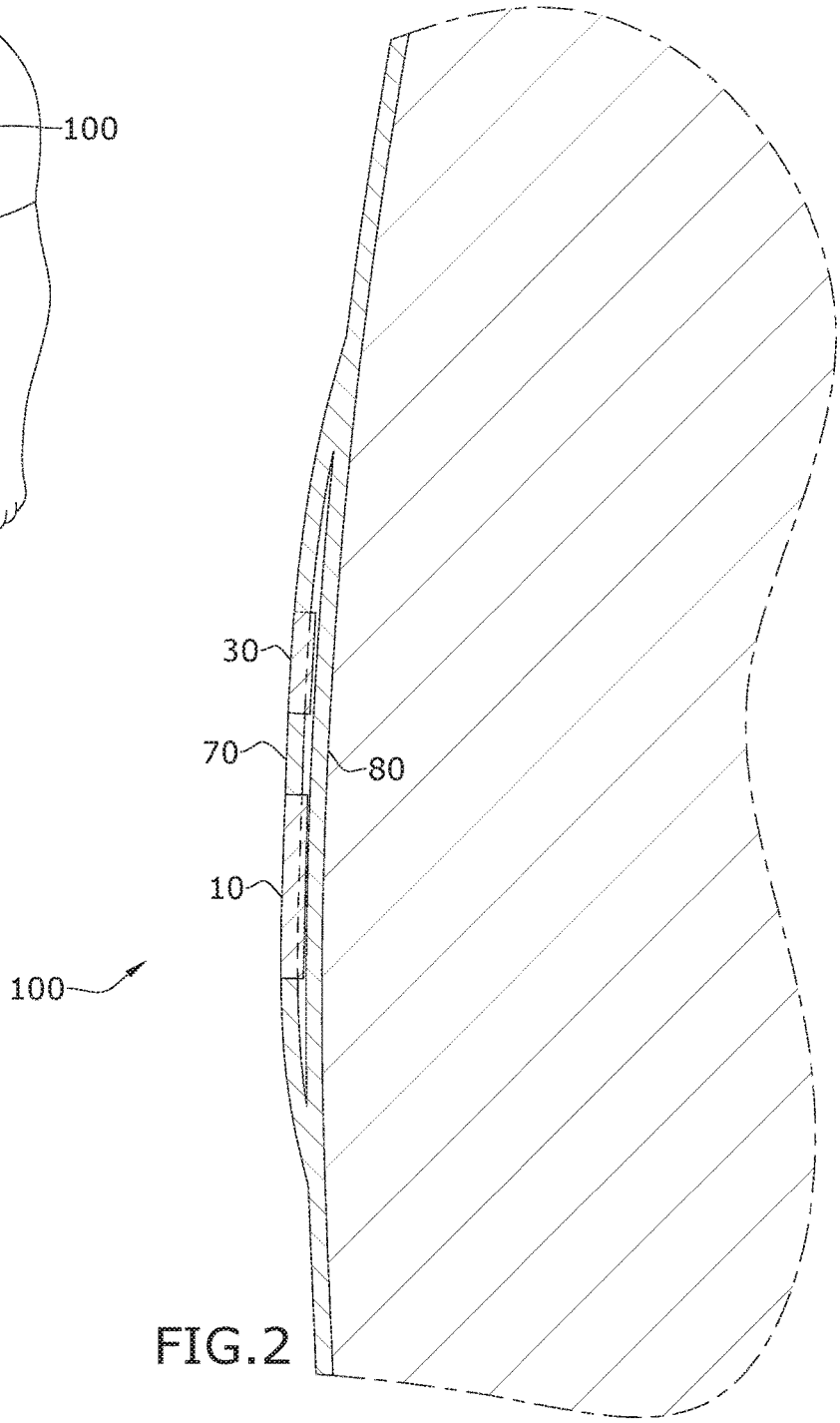
FIG. 2 is a partial section view of an exemplary embodiment of the present invention, taken along line 2-2 in FIG. 1.
Figure 3:
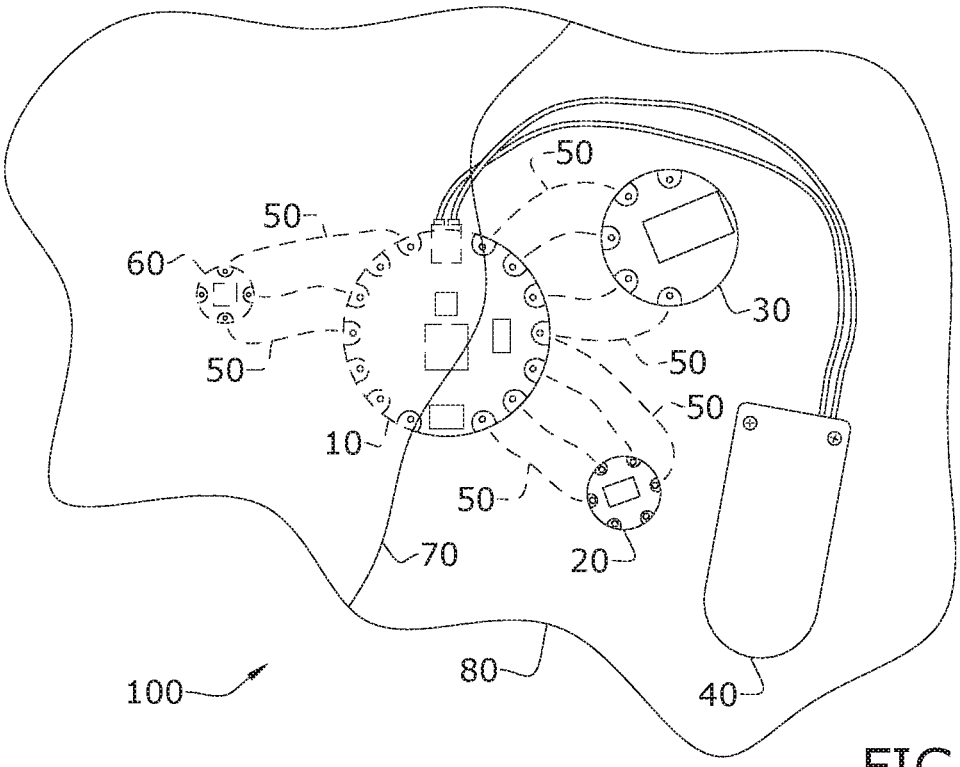
FIG. 3 is an enlarged schematic view of an exemplary embodiment of the present invention.
Figure 4:
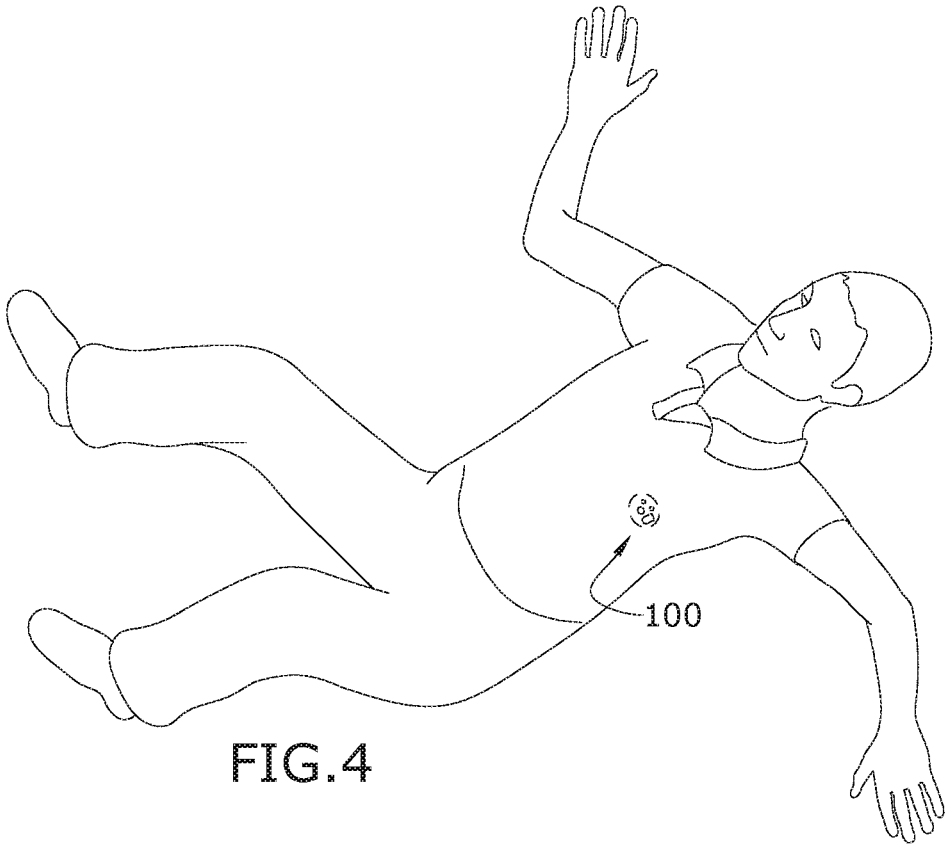
FIG. 4 is a schematic view of an exemplary embodiment of the present invention, shown in use in a fallen position.

A method of manufacturing the present invention may include using conductive thread 50 (for example, a thread that is coated with stainless steel) to electrically couple the modules 10, 20, 30 and 40 together while physically sewing the modules 10, 20, 30 and 40 onto an article of clothing or an accessory, typically between an inner layer of material 80 and an outer layer of material 70, as illustrated in FIG. 2. The systemic software communicates to and monitors each module 10, 20, 30 and 40. The software enables bi-directional communications meaning that once an alert was sent, additional data could be gathered (for example, heart sensor monitoring, breathing sensor monitoring, or other vital sign statistic monitoring), further specifying the type and criticality of the situation—in such embodiments, the appropriate sensors may likewise be electrically coupled to the modules 10, 20, 30 and 40 and sewn so as to be wearable with the conductive thread 50.

Another embodiment may include a panic button switch 60 on the device if the person has not "fallen" yet is still in some kind of medical emergency and needs to call for help. Pressure pad sensors could be added for 'at risk' patients who may be bed-ridden and if the attempt to get up the pad sensors automatically transmit notifications to medical personnel.

The device 100 is meant to be fully automated with no interference or activity by the person. The device 100 is self-contained and is designed to be worn with as little impact and required interaction with the device as possible.

It should be understood, of course, that the foregoing relates to exemplary embodiments of the invention and that modifications may be made without departing from the spirit and scope of the invention as set forth in the following claims.

What is claimed is:

1. A wearable fall detection device comprising:

a plurality of components comprising:

an accelerometer;

a control circuitry;

a wireless communicator; and a plurality of conductive threading electrically connecting the accelerometer, the control circuitry, and the wireless communicator in such a way that the wearable fall detection device is connected to a wearable piece of material the control circuitry configured to:

determine its location along an X-axis, a Y-axis, and a Z-axis at a predetermined time period in such a way as to determine a rate of fall along the Z-axis for a wearer of the two abutting pieces of material;

compare the rate of fall to a gravity fall rate; and define a fall event when the rate of fall equals to or is greater than the gravity rate of fall, and wherein the predetermined time period is more than zero seconds and less than ten seconds.

2. The wearable fall detection device of claim 1, further comprising:

a power source electrically connected to the control circuitry.

3. The wearable fall detection device of claim 1, wherein the plurality of conductive threading comprises stainless steel thread.

4. The wearable fall detection device of claim 1, further comprising:

the control circuitry configured to determine a fall event of a wearer of the two abutting pieces of material.

* * * * *